US006637297B1

(12) United States Patent
Mlynarczyk

(10) Patent No.: US 6,637,297 B1
(45) Date of Patent: Oct. 28, 2003

(54) ECCENTRIC DRIVE SOCKET

(75) Inventor: John Everett Mlynarczyk, Lowell, IN (US)

(73) Assignee: John Mlynarczyk, Lowell, IN (US)

( * ) Notice: Subject to any disclaimer, the term of this patent is extended or adjusted under 35 U.S.C. 154(b) by 0 days.

(21) Appl. No.: 10/274,789

(22) Filed: Oct. 21, 2002

(51) Int. Cl.[7] ..... B25B 13/00
(52) U.S. Cl. ..... 81/124.3; 81/121.1
(58) Field of Search ..... 81/124.3, 121.1, 81/121.5, 124.7

(56) References Cited

U.S. PATENT DOCUMENTS 1,533,784 A * 4/1925 Bellows ..... 81/124.7
1,705,470 A * 3/1929 Chirpe ..... 81/124.3
2,094,584 A * 10/1937 Cox ..... 81/471
5,549,022 A * 8/1996 Knox ..... 81/124.2
H1689 H * 11/1997 Foucher ..... 81/124.3
6,138,533 A * 10/2000 Turtle ..... 81/124.3

FOREIGN PATENT DOCUMENTS

EP 3210039 A1 * 9/1983 ..... 81/121.1

* cited by examiner

*Primary Examiner*—Lee D. Wilson

(57) ABSTRACT

The eccentric drive socket is a one piece socket member with a drive lever having a square hole placed off center to the socket member body. The socket member body has a though hole allowing the fastener to pass through. The relationship between the socket member body and the drive lever allow this tool to fit down inside and to be rotated in obstructed or confined areas.

1 Claim, 1 Drawing Sheet

ECCENTRIC DRIVE SOCKET

CROSS-REFERENCE TO RELATED APPLICATION

Not Applicable

STATEMENT REQUARDING FEDERALLY SPONSERED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates to a socket used to engage a fastener, screw head, nut, bolt, and more particularly, but not limited to a spark plug obstructed by an exhaust manifold.

Many exhaust manifolds and headers limit the distance between them and the top of a spark plug, so much that an ordinary spark plug socket will not fit. In these cases the exhaust manifold must be loosened from or completely removed from the head. Reassembling the manifold includes replacing gaskets, refilling fluid, and reassembling other items that restricted the manifold. To remove and replace the spark plug in this method, greatly increases time and cost. Therefore, a socket capable of loosening and tightening a spark plug without removing any other parts would be a great improvement.

BRIEF SUMMARY OF THE INVENTION

In accordance with the present invention, an eccentric drive socket is comprised of a socket with a large through hole and a square drive at the top which is offset from the center of the socket.

It is therefore an object of the present invention to provide a socket that engages an obstructed fastener such as a screw head, nut, bolt, or spark plug.

It is a further object of the present invention to provide a socket that permits tightening and loosening of spark plugs without disconnecting an exhaust manifold or any other obstruction.

Still other obvious objects, features, and advantages of the present invention will become evident to those of ordinary skill in art of the following.

DETAILED DESCRIPTION OF THE INVENTION

Figure 1:
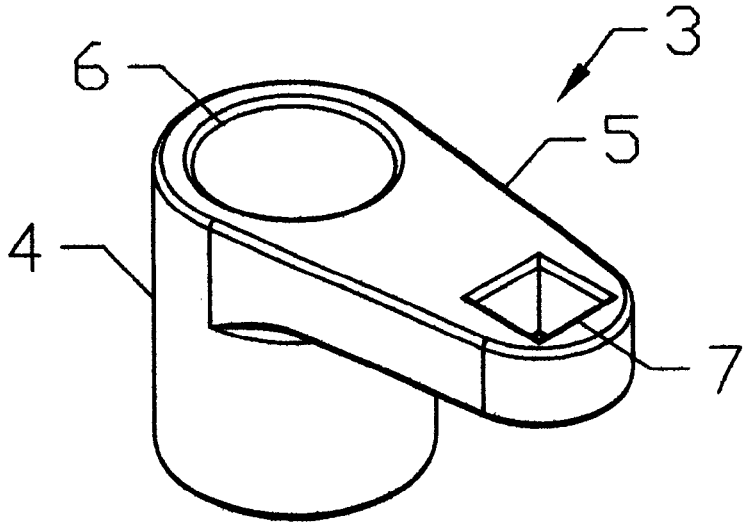
FIG. 1 is a perspective view from above illustrating an eccentric drive socket.
Figure 2:
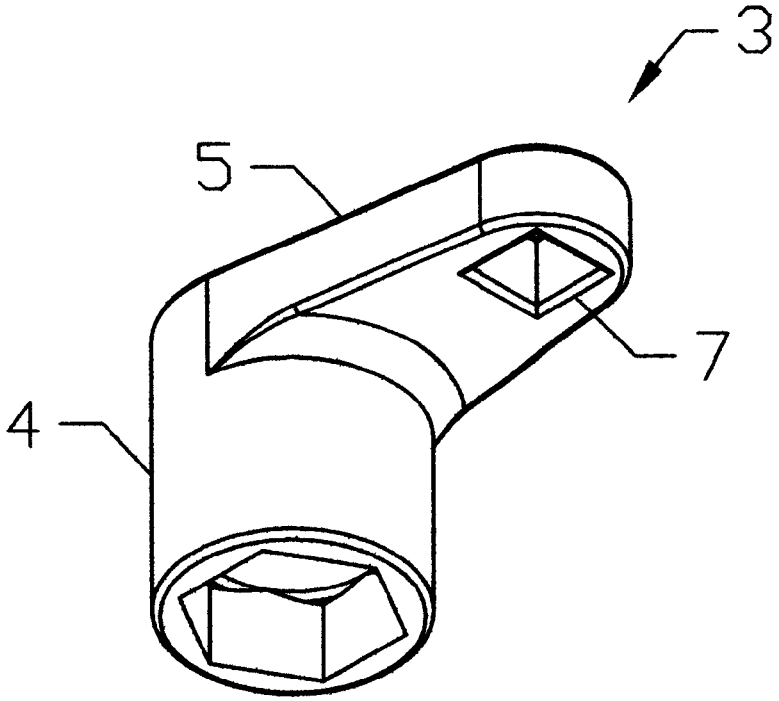
FIG. 2 is a perspective view from below illustrating an eccentric drive socket.

An eccentric drive socket 3 consists of a socket member 4 and an eccentric drive lever 5. The socket member 4 in this preferred embodiment is cylindrical in shape with a though hole 6 and includes a hexagonally shaped interior portion that defines a six-point engaging surface for a spark plug or a fastening device, such as a nut, bolt-head, or screw-head.

The eccentric drive lever 5 in this preferred embodiment is perpendicular to and at the top of socket member 4. Eccentric drive lever 5 has a square hole 7 far enough from the center of socket member 4 to allow engagement with a tool and still allow an unobstructed passage through the socket member 4.

Although the present invention has been described in terms of the forgoing embodiment such description has been for exemplary purposes only and as will be apparent to those of ordinary skill in the art, many alternatives, equivalents, and variations of varying degrees will fall within the scope of the present invention. That scope, accordingly, is not to be limited in any respect by the forgoing description; rather it is defined by the claims that follow.

What I claim as my invention is:

1. A tool for engaging a spark plug or fastening device to permit the tightening or loosening of the spark plug or fastening devise comprising:

a socket member with an interior surface that provides an engaging surface and a through passage for a spark plug or fastening device;

said socket member being of a predetermined size and shape that will allow it to fit in a counter bored area that is obstructed around a spark plug or fastening device;

an eccentric drive lever having a square hole at a predetermined distance from the center line of said socket member;

said eccentric drive lever of a predetermined length is long enough not to obstruct said through passage when drive mechanism is engaged, but short enough to allow access and movement in confined space;

said eccentric drive lever of a predetermined placement on said socket member allows adequate clearance for full engagement of spark plug or fastening device;

whereby a spark plug or fastening device can be loosened or tightened in an obstructed or confined space.

* * * * *